United States Patent [19]

Brush et al.

[11] 4,272,144

[45] Jun. 9, 1981

[54] SPRING LOADED ANTI-ROTATION DEVICE FOR ELECTRICAL CONNECTORS

[75] Inventors: Robert W. Brush, Unadilla; Dee A. Werth, Nineveh; Alan L. Schildkraut, Sidney, all of N.Y.

[73] Assignee: The Bendix Corporation, Southfield, Mich.

[21] Appl. No.: 104,993

[22] Filed: Dec. 18, 1979

[51] Int. Cl.[3] ..... H01R 13/639

[52] U.S. Cl. ..... 339/89 R; 339/DIG. 2

[58] Field of Search ..... 339/89, 90, DIG. 2; 235/89, 92; 151/25 A, 25 B, 25 C, 25 R

[56] References Cited

U.S. PATENT DOCUMENTS

| | | | |
|---|---|---|---|
| 994,688 | 6/1911 | Parks | 151/25 A |
| 1,450,066 | 4/1923 | Dodds | 151/25 R |
| 3,343,852 | 9/1967 | Blight et al. | 339/DIG. 2 |
| 3,587,032 | 6/1971 | Normann | 339/DIG. 2 |
| 3,601,764 | 8/1971 | Cameron | 339/89 M |
| 4,109,990 | 8/1978 | Waldron et al. | 339/113 R |

*Primary Examiner*—John McQuade

*Attorney, Agent, or Firm*—John R. Benefiel; Raymond J. Eifler

[57] ABSTRACT

An anti-rotation feature is disclosed for preventing inadvertent disconnection of electrical connector assemblies of the type including mating plug and receptacle shells positioned in mating relationship with a surrounding coupling nut which threadedly engages one of the members and axially engages the other to draw the same into mating relationship upon rotation of the coupling nut. An elongated rod or axle extends chordally across the interior bore of the coupling nut member, with an axially movable element positioned on the axle by a pair of centering springs. The movable element is in engagement with a series of serrations formed about the periphery of one of the electrical connector components so that the centering springs resist relative rotation between the coupling nut and connector component until the spring resistance is overcome to allow relative rotation between the coupling nut member and the connector components. The serration flank geometry is asymmetrical to enable easier rotation between the coupling nut member and connector components in the direction of rotation corresponding to coupling of the connector components. Different strength centering springs are also used in engagement on either side of the engagement element to also produce the difference in resistance to rotation.

10 Claims, 4 Drawing Figures

SPRING LOADED ANTI-ROTATION DEVICE FOR ELECTRICAL CONNECTORS

BACKGROUND DISCUSSION

A typical electrical connector arrangement includes mating electrical connector components, including cylindrical plug and receptacle shells, each carrying respective electrical contacts which are moved into mating engagement by axial relative movement between the plug shell and receptacle shell. Such axial movement is produced by a coupling nut member received over the plug shell and receptacle shell which threadedly engages one of the components and axially engages the other such that upon rotation of the coupling nut member in one direction, the components are drawn together, and once the components are fully advanced into the connected state, the coupling nut member acts to retain the connector components in their connected relationship.

Disconnection is produced by backing off of the coupling nut member and separating the connector components.

In usual situations, friction in the threaded and other abutting surfaces is relied on to restrain the coupling nut member from loosening and back off once the components have been fully assembled.

In environments in which the connector assembly may be subjected to vibration, such frictional resistance to loosening of the coupling nut member may not be adequate to preclude backing off of the coupling nut member and the possibility of inadvertent separation of the electrical connector components.

Accordingly, anti-rotation devices have been incorporated in such electrical connectors, an example of such anti-rotation device disclosed in U.S. Pat. No. 4,109,990.

This patent describes an anti-rotation arrangement consisting of a spring element formed with a tooth and engaged with a series of serrations disposed about the exterior of one of the connector components. The spring is carried on the interior of the coupling nut member extending chordally across the interior bore thereof.

The engagement of the spring tooth with the serrations results in a resistance to relative rotation at force levels below that required to cam the spring tooth element out of engagement with the serrations engaged therewith. The serration profile is disclosed as being asymmetrical in order that its resistance to camming the spring tooth element out of engagement therewith is easier in one direction than the other to enable ready coupling of the connector by rotation of the coupling nut member in one direction.

The fixed position of the tooth element on the spring involved, however, makes the geometry of the serration profile critical insofar as determining turning effort, and a relatively wide variation in turning effort encountered with this design.

Application Ser. No. 101,372, filed Dec. 7, 1979, discloses another such anti-rotation arrangement including a deflectable mandrel mounted within the interior bore of the coupling nut member and chordally across the opening thereof with a clearance space between the mandrel and the outside diameter of one of the connector components. The ball element is slidably mounted on the mandrel and is located in either of two positions on either side of the clearance space and fixed stops retain the ball element in frictional engagement with the outside diameter of the connector component in either position.

Rotation of the coupling nut in one direction is resisted only by the frictional contact forces, this direction being in the direction producing coupling of the connector components. Rotation of the coupling nut member in the other direction produces a wedging effect between the sliding element and the connector component which resists rotation with much heavier force. Once a rotative force is applied sufficient to overcome the resistance presented by stiffness of the mandrel, the ball shifts to the other position with the resistance of rotation being rendered easier in the other direction of rotation which corresponds to the direction of the decoupling of the connector assembly.

In copending application Ser. No. 104,994, filed Dec. 18, 1979, there is disclosed an arrangement for increasing the frictional forces available to resist backing off of the coupling nut member as described therein to provide an anti-rotation feature between the coupling nut member and the connector components.

While generally satisfactory, efforts are constantly being applied to provide such anti-rotation features which are evermore simple and reliable in order to provide such feature for the connector which will only minimally increase manufacturing costs, while being suitable for employment in vibration environments.

It is also of course advantageous that the coupling and decoupling manipulation of the coupling nut member be enabled notwithstanding the provision of the anti-rotation features. That is, the coupling nut member must be enabled to be manipulated and rotated so as to release the connector components and such anti-rotation feature should not render this assembly difficult.

Accordingly, it is an object of the present invention to provide an anti-rotation feature for electrical connectors of the type in which the components are of a generally cylindrical configuration and which are mated by axial movement therebetween produced by a threaded coupling nut member utilized to draw the components into mating relationship and to maintain the same assembled.

It is yet another object of the present invention to provide such anti-rotation feature which is simple and reliable in operation and which the turning effort required to overcome the anti-rotation feature is accurately controlled without requiring a high degree of precision in the mating components.

It is still another object of the present invention to provide such anti-rotation feature in which the resistance to rotation of the coupling nut member in a direction corresponding to release of the connector components is much greater than in that direction corresponding to coupling of the connector components.

It is still another object of the present invention to provide such anti-rotation feature which allows the anti-rotation feature to be overcome in order to enable disassembly of the connector components.

SUMMARY OF THE INVENTION

These and other objects of the present invention, which will become apparent upon a reading of the following specification and claims, are achieved by an anti-rotation feature consisting of an elongated rod or axle which is mounted to extend chordally across the interior bore of the coupling nut member. Mounted on the axle is a slidable engagement element consisting of a small rounded wheel which is caused to be normally centered on the axle by means of a pair of centering springs in engagement with either side of the wheel element.

The wheel element is disposed so as to engage the intermediate spaces between a series of serrations extending about the periphery of one of the connector components to thereby resist relative rotation by virtue of the resisting force exerted by the centering springs.

Upon the application of a turning force sufficiently high to overcome the resisting force of the centering spring, the wheel element is cammed aside by the side of one of the serrations between which it lies in order to carry out coupling and decoupling of the connector assembly.

The inclination of the serration flanks is such as to present a relatively more steep angle to the wheel element in one direction of rotation than the other in order to provide lesser resistance in one direction of rotation of the coupling nut member than the other. This direction of rotation corresponds to the rotation of the coupling nut member occurring during coupling of the connector assembly to thus reduce the effort required to rotate the coupling nut member in this direction.

The centering springs may also be of differing spring rates in order to further reduce the effort required in rotating the coupling nut member during assembly by providing a stiffer centering spring on the side resisting uncoupling rotation than the centering spring on the side resisting coupling rotation of the coupling nut member.

A plurality of such axle and wheel element assemblies may be provided about the axis of the coupling nut member.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
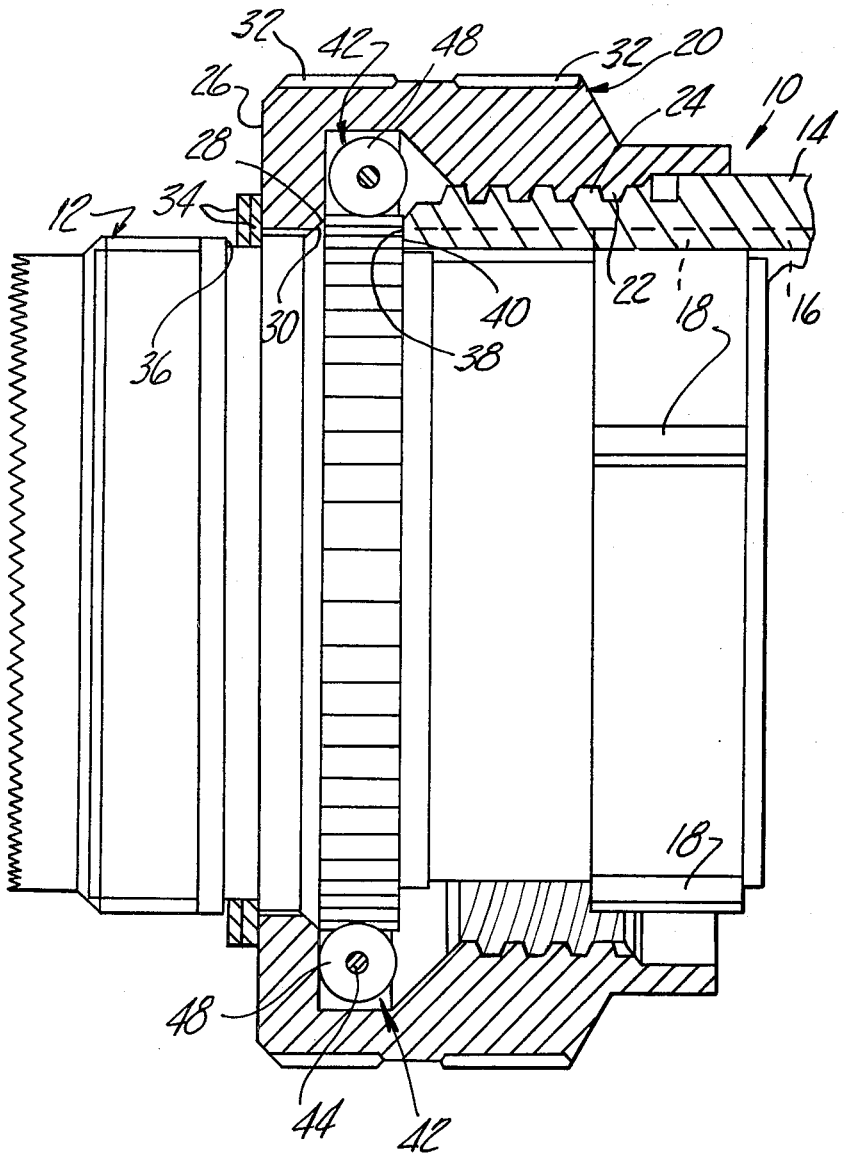
FIG. 1 is a longitudinal fragmentary view in partial section of an electrical connector assembly incorporating the anti-rotation feature according to the present invention.

FIG. 1 is a longitudinal view of the electrical connector assembly 10 of the type for which the anti-rotation arrangement according to the present invention is intended to be used. This type of connector components include a plug shell 12 and receptacle shell 14, both being of generally cylindrical configuration and both carrying electrical contacts (not shown) which are moved into mating relationship by relative axial movement of the plug shell 12 and receptacle shell 14. The connector assembly 10 is shown in the fully mated position in FIG. 1.

The receptacle shell 14 is provided with keyways 16 which mate with keys 18 disposed about the periphery of the plug shell 12 to properly orient the plug shell 12 and receptacle shell 14.

Also provided is a coupling nut member 20 which is received over the plug shell 12 and receptacle shell 14 which acts to move the plug shell 12 and receptacle shell 14 axially into mating relationship and securing the same in the assembled or mated position.

The coupling nut member 20 is threadedly engaged with one of the connector components, i.e., the receptacle shell 14, as shown in FIG. 1, by means of an internal thread 22 formed on the coupling nut member 20 and external thread 24 formed on the outside diameter of the receptacle shell 14.

The coupling nut member 20 is also axially in engagement with the other of the electrical connector components, i.e., plug shell 12, by means of an inwardly extending flange 26 formed on the coupling nut member 20 and a shoulder 28 formed on the outside diameter of the plug shell 12.

The flange 26 is provided with a tapering shoulder indicated at 30 which provides an abutment against which the shoulder 28 is engaged. The nature of this engagement offers advantages in providing an additional anti-rotation feature as is described in the above-cited U.S. Pat. application Ser. No. 104,994, filed Dec. 18, 1979.

Thus, rotation of the coupling nut member 20 in the direction tending to cause advance of the receptacle shell 14 to the left as shown in FIG. 1 is relied on in order to produce relative coupling movement between the plug shell 12 and receptacle shell 14.

Knurling 32 is provided in order to facilitate rotation of the coupling nut member 20.

The coupling nut member 20 is retained on the plug shell 12 by means of a snap retainer 34 disposed in a recess 36 formed about the periphery of the plug shell 12. Rotation of the coupling nut member 20 continues until the plug shell 12 and receptacle shell 14 are in the fully mated position at which point the endface 38 of the receptacle shell 14 is moved into abutment with a shoulder 40 formed about the periphery of the plug shell 12.

At this point, the mating tapered shoulders 28 and 30 are drawn into tight engagement, centering the coupling nut member 20 and also increasing the frictional force tending to resist the uncoupling rotation of the coupling nut member 20.

According to the concept of the present invention, a specific anti-rotation means is provided which includes a plurality of anti-rotation assemblies 42 disposed about the internal axis of the coupling nut member 20.

Each anti-rotation assembly 42 includes an axle 44 comprised of a rod-like member carried by the coupling nut member 20 and disposed in the interior bore 46 thereof to extend in a radial plane and chordally across the interior bore 46.

Figure 2:
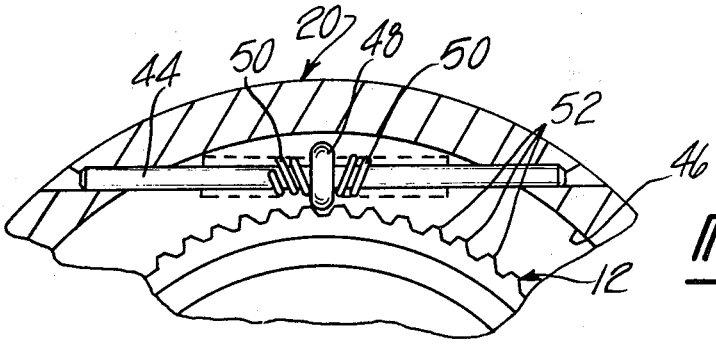
FIG. 2 is a fragmentary enlarged endwise view of the electrical connector assembly shown in FIG. 1 illustrating one of the anti-vibration wheel and axle assemblies incorporated in the connector assembly of FIG. 1.

Slidably mounted on the axle 44 is an engagement element comprised of the wheel 48 as depicted in FIG. 2. The wheel 48 is biased to a central location on the axle 44 by a pair of centering springs 50 which are in engagement with either side of the wheel 48 and which resist any tendency for the wheel 48 to move axially on the axle 44 in either direction to the right or left as viewed in FIG. 2.

Each wheel 48 is disposed so as to lie intermediate a series of serrations 52 formed about the axis of the other of the electrical connector components, i.e., the plug shell 12, such that relative rotation between the coupling nut member 20 and the plug shell 12 is resisted by engagement of the sides of the serrations 52 with the wheel 48 and the stiffness of the centering spring 50.

However, upon application of sufficient turning force, the centering spring force 50 may be overcome allowing the wheel to be moved over the axle 44 sufficiently to enable the serrations 52 to move past the wheel 48. This therefore allows the rotation of the coupling nut member 20 relative to the plug shell 12 and receptacle shell 14 to execute coupling or uncoupling rotation of the coupling nut member 20.

Figure 3:
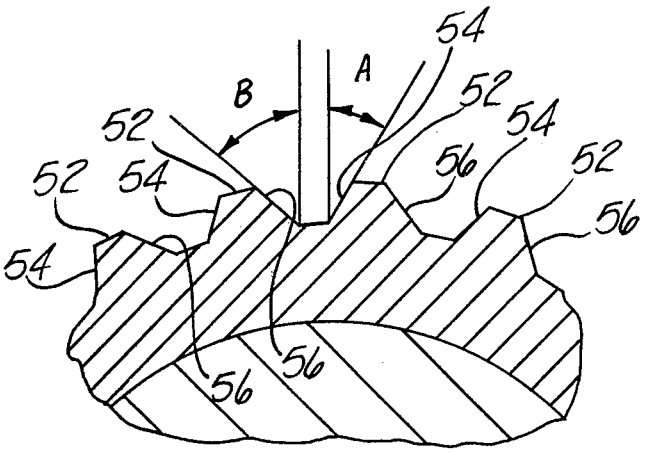
FIG. 3 is an enlarged fragmentary endwise view of a portion of the connector components shown in FIGS. 1 and 2 indicating the relative inclination of the serration flanks.

In order to facilitate the coupling rotation, the serrations 52 are provided with asymmetrically inclined sides 54, 56 as indicated in FIG. 3. The angle of tooth sides 54 is relatively steeper, i.e., angle "A", whereas the opposite sides are inclined at a more shallow angle "B". Therefore, the camming effect of serrations 52 act on the wheel 48 and is such that a greater mechanical advantage is effected in one direction than the other.

This direction is related to the direction of the threaded engagement between the coupling nut member 20 and the receptacle shell 14, such that a greater resistance to relative rotation of the coupling nut member 20 is presented in a direction corresponding to uncoupling of the connector components than in the direction corresponding to coupling of the connector components.

Accordingly, relatively less resistance to rotation is presented by the centering spring force 50 when the coupling nut member 20 is being rotated in the direction drawing the connector components together than when the coupling nut member 20 is rotated in the opposite direction.

Accordingly, this effort is minimized while still insuring that the relatively heavy resistance is presented to any tendency for the coupling nut member 20 to back off its threaded engagement with the receptacle shell 14.

At the same time, however, if sufficiently high force is applied to the coupling nut member 20, uncoupling rotation of the coupling nut member 20 can be effected, thus enabling disassembly of the connector assembly 10.

Figure 4:
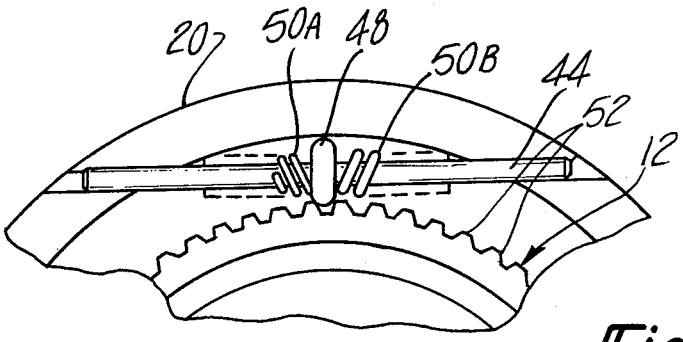
FIG. 4 is a fragmentary endwise view of an alternate form of the anti-rotation assembly shown in FIGS. 1 and 2.

In order to further augment this effect or as an alternative thereto, the centering spring force 50 can be made of differing spring rates. This arrangement is indicated in FIG. 4 in which a lefthand spring 50A is provided of a lesser spring rate than the righthand centering spring indicated at 50B and is of heavier construction and presenting a heavier resistance to axial or endwise movement of the wheel 48.

This is likewise selected to correspond to the direction of threaded engagement such that the lower spring rate spring 50A is compressed by relative rotation of the coupling nut member 20 and the plug shell 12 in the direction tending to coupling of the plug shell 12 and receptacle shell 14.

Accordingly, it can be seen that the above-recited objects of the present invention have been achieved by this arrangement and that a relatively simple and reliable arrangement has been provided for providing an anti-rotation resistance which resistance does not substantially interfere with uncoupling of the coupling and uncoupling manipulation of the coupling nut member 20.

At the same time, this arrangement is simple and low in cost and can be added with only minimal additional manufacturing costs and should operate in a highly reliable manner.

The axial or endwise movement of the wheel on the axle insures that a resistance to rotation can be accurately controlled by the spring force and tooth side angles without the necessity for a high degree of precision in the manufacture of the components.

The embodiments of the invention in which an exclusive property or privilege is claimed are defined as follows:

1. An electrical connector comprising:

first and second generally cylindrical electrical connector bodies carrying mating electrical contacts and adapted to be advanced into mating engagement by relative axial movement therebetween;

a coupling nut member having an internal passage adapted to receive said first and second electrical connector bodies, said internal passage having an internal thread section formed therein adapted to be threadedly engaged with an external thread formed on one of said first or second electrical connector bodies;

said coupling nut member further including a radially inwardly extending portion engaging said other of said first or second electrical connector bodies to enable said coupling nut member to cause relative axial advance of said one of said first or second electrical connector bodies into engagement with said other of said first or second connector bodies;

anti-decoupling means resisting relative rotation between said coupling nut member and said mated first and second electrical connector bodies in the direction producing uncoupling of said first or second electrical connector bodies while enabling rotation of said coupling nut member in the opposite direction tending to produce coupling movement of said first and second electrical connector bodies, said anti-decoupling means comprising:

an axle mounted within said coupling nut member internal passage so as to lie in a radial plane and extending transversely to the axis of said coupling nut member;

an engagement element mounted to be slidable on said axle;

bias means urging said engagement element into an intermediate position on said axle;

a circumferentially extending series of serrations formed on said other of said first or second connector bodies, the spaces intermediate said serrations receiving said engagement element;

whereby axial movement of said engagement element on said axle accommodates relative rotation of said nut member and said first and second electrical connector bodies during rotation thereof to produce said mating engagement of said first and second electrical connector bodies, while said rotation is resisted by said bias means resisting said axial movement of said engagement element.

2. The electrical connector according to claim 1 wherein said engagement element comprises a wheel mounted on said axle.

3. The electrical connector according to claim 2 wherein said axle is disposed in a pocket extending into the internal passage of said coupling nut member, said axle extending across said pocket.

4. The electrical connector according to claim 2 wherein a plurality of said axles and corresponding wheels are provided about the axis of said electrical connector, each of said wheels received between said serrations.

5. The electrical connector according to claim 1 wherein said bias means comprises springs mounted on said axle and extending into engagement with either side of said engagement element.

6. The electrical connector according to claim 5 wherein one of said springs has a stiffer spring rate than the other of said springs, said one spring located on the side of said wheel in a direction corresponding to unthreading of said coupling nut member and said one of said electrical connector bodies, whereby a stronger resistance is provided to uncoupling rotation of said nut member than to coupling rotation of said coupling nut member on said one of said first or second electrical connector bodies.

7. The electrical connector according to claim 2 wherein said coupling nut member is formed with a radially inward extending flange portion thereof and wherein said other of said electrical connector bodies is formed with a shoulder adjacent thereto adapted to be engaged by said flange portion to provide axial securement thereof and wherein said circumferentially extending series of serrations are formed adjacent said shoulder on the radially outermost side thereof.

8. The electrical connector according to claim 1 wherein said serration series comprises sloping flank surfaces on either side of each of said serrations forming intermediate spaces receiving said engagement element, said sloping flank surface on one side of each of said serrations in said series being more shallowly sloped in the direction corresponding to coupling rotation of said coupling nut member, whereby said resistance to rotation of said coupling nut member is less than in the opposite direction to create a relatively higher resistance to rotation in a direction producing uncoupling.

9. In an electrical connector of the type including a receptacle shell and a mating plug shell carrying electrical contacts and adapted to be moved into mating relationship by axial movement therebetween, said axial movement being carried out by a coupling nut member threadedly engaging one of said plug shell or receptacle shell and axially engaging the other of said plug shell or receptacle shell to cause axial advancing movement upon rotation of said coupling nut member by said threaded engagement therebetween, the improvement comprising:

anti-decoupling means for resisting relative rotation between said coupling nut member and said other of said plug shell or receptacle shell, said anti-decoupling means comprising at least one axle member mounted within said coupling nut member and extending in a generally radial plane and transversely to the axis of said electrical connector, said at least one axle member supported at either end to said coupling nut member;

a wheel element mounted to be slidable on said at least one axle member intermediate said supported ends;

bias means urging said wheel element to a position on said at least one axle member intermediate said supported ends;

a series of serrations disposed about said connector axis with intermediate spaces between said serrations receiving said wheel element, said serrations being formed on said other of said receptacle shell or plug shell;

whereby sliding movement of said wheel element on said at least one axle member accommodates relative rotation of said coupling nut member while said bias means resists relative rotation.

10. A coupling system for joining first and second generally cylindrical bodies adapted to be advanced into mating engagement by relative axial movement therebetween, said system comprising:

a first generally cylindrical body;

a second generally cylindrical body;

a coupling nut member having an internal passage adapted to receive said first and second bodies, said internal passage having an internal threaded section formed therein adapted to be threadedly engaged with an external thread formed on one of said first or second bodies;

said coupling nut member further including a radially inwardly extending portion engaging said other of said first or second bodies to enable said coupling nut member to cause relative axial advance of said one of said first or second bodies into engagement with said other of said first or second bodies;

anti-decoupling means resisting relative rotation between said coupling nut member and said joined first and second bodies in the direction producing uncoupling of said first and second bodies while enabling rotation of said coupling nut member in the opposite direction tending to produce coupling movement of said first and second bodies, said anti-decoupling means comprising:

an axle mounted within said coupling nut member internal passage so as to lie in a radial plane and extending transversely to the axis of said coupling nut member;

an engagement element mounted to be slidable on said axle;

bias means urging said engagement element into an intermediate position on said axle;

a circumferentially extending series of serrations formed on said other of said first or second bodies, the spaces intermediate said serrations receiving said engagement element;

whereby axial movement of said engagement element on said axle accommodates relative rotation of said nut member and said first and second bodies during rotation thereof to produce said mating engagement of said first and second bodies, while said rotation is resisted by said bias means resisting said axial movement of said engagement element.

* * * * *